US009029723B2

(12) United States Patent
Pegg

(10) Patent No.: US 9,029,723 B2
(45) Date of Patent: May 12, 2015

(54) KEYPAD APPARATUS AND METHODS

(75) Inventor: Albert Murray Pegg, Cambridge (CA)

(73) Assignee: BlackBerry Limited, Waterloo, Ontario (CA)

( * ) Notice: Subject to any disclaimer, the term of this patent is extended or adjusted under 35 U.S.C. 154(b) by 1127 days.

(21) Appl. No.: 12/982,090

(22) Filed: Dec. 30, 2010

(65) Prior Publication Data

US 2012/0168294 A1 Jul. 5, 2012

(51) Int. Cl.
*H01H 13/14* (2006.01)
*H01H 13/83* (2006.01)
*H01H 13/702* (2006.01)

(52) U.S. Cl.
CPC ..... *H01H 13/83* (2013.01); *Y10T 29/49105* (2015.01); *H01H 13/702* (2013.01); *H01H 2215/008* (2013.01); *H01H 2219/034* (2013.01); *H01H 2229/047* (2013.01)

(58) Field of Classification Search
CPC ..... H01H 13/14; H01H 13/704; H01H 13/88; H01H 13/702; H01H 13/705; H01H 13/7057; H01H 13/7073; H01H 13/85; H01H 11/00; H01H 13/70; H01H 13/7065; H01H 13/79
USPC ..... 200/520
See application file for complete search history.

(56) References Cited

U.S. PATENT DOCUMENTS

| | | | | |
|---|---|---|---|---|
| 4,395,817 | A | 8/1983 | Asada et al. | |
| 5,032,695 | A * | 7/1991 | Mullins | 200/512 |
| 6,603,086 | B2 | 8/2003 | Kawaguchi et al. | |
| 6,887,001 | B2 | 5/2005 | Kitamura et al. | |
| 6,956,561 | B2 | 10/2005 | Han | |
| 7,027,036 | B2 | 4/2006 | Yang | |
| 7,133,707 | B1 | 11/2006 | Rak et al. | |
| 7,252,444 | B2 | 8/2007 | Ladouceur | |
| 7,601,926 | B2 | 10/2009 | Kim et al. | |
| 7,671,290 | B2 | 3/2010 | Chen et al. | |
| 2003/0041443 | A1 | 3/2003 | Stevenson et al. | |
| 2005/0281605 | A1 | 12/2005 | Dombrowski et al. | |
| 2006/0097035 | A1 | 5/2006 | Castaneda et al. | |
| 2007/0018855 | A1 | 1/2007 | Griffin et al. | |
| 2007/0039809 | A1 | 2/2007 | Aihara et al. | |
| 2007/0151838 | A1 | 7/2007 | Lundell et al. | |

(Continued)

OTHER PUBLICATIONS

European Patent Office, "Extended European Search Report," issued in connection with European application serial No. 10197362.6, issued Jul. 19, 2011, 7 pages.

(Continued)

*Primary Examiner* — Renee Luebke
*Assistant Examiner* — Lheiren Mae A Caroc
(74) *Attorney, Agent, or Firm* — Fish & Richardson P.C.

(57) ABSTRACT

Keypad apparatus and methods are described herein. An example keypad includes a keypad support having a first surface defining a cavity, and an electrical switch assembly coupled to the keypad support. The electrical switch includes a printed circuit board having at least a portion repositioned relative to a second surface of the printed circuit board. The repositioned portion is located in the cavity and the second surface is located on the first surface of the keypad support when the printed circuit board is coupled to the keypad support. The repositioned portion is attached to the second surface of the printed circuit board. A dome switch is aligned with the repositioned portion of the printed circuit board and is at least partially positioned in the cavity of the keypad support.

20 Claims, 8 Drawing Sheets

(56) References Cited

U.S. PATENT DOCUMENTS

| | | | | |
|---|---|---|---|---|
| 2007/0205986 | A1 | 9/2007 | Kim et al. | |
| 2007/0247828 | A1 | 10/2007 | Kim | |
| 2007/0296702 | A1 | 12/2007 | Strawn et al. | |
| 2008/0030975 | A1 | 2/2008 | Miyashita et al. | |
| 2008/0064451 | A1 | 3/2008 | Lee et al. | |
| 2009/0159412 | A1 | 6/2009 | Liu et al. | |
| 2009/0207054 | A1 | 8/2009 | Rak et al. | |
| 2009/0236207 | A1 | 9/2009 | Shi et al. | |
| 2009/0277763 | A1 | 11/2009 | Kyowski et al. | |
| 2010/0085217 | A1 | 4/2010 | Chen | |
| 2010/0164872 | A1 | 7/2010 | Griffin et al. | |
| 2010/0213043 | A1 | 8/2010 | Chen et al. | |
| 2011/0079497 | A1 * | 4/2011 | Ng et al. | 200/314 |

OTHER PUBLICATIONS

Top Bound USA, "Keypad Backlighting," © 2010, last retrieved from http://topboundusa.com/keypads.html., Dec. 27, 2010, 10 pages.

Canadian Intellectual Property Office, "Office Action," issued in connection with Canadian Patent Application No. 2,759,475, Oct. 28, 2013, 2 pages.

European Patent Office, "Intent to Grant," issued in connection with European Patent Application No. 10 197 362.6, Oct. 30, 2013, 7 pages.

Canadian Intellectual Property Office, "Requisition by the Examiner in Accordance with Subsection 30 (2) of the Patent Rules," issued in connection with Canadian Patent Application No. 2,759,475, on Oct. 28, 2013, 2 pages.

* cited by examiner

KEYPAD APPARATUS AND METHODS

FIELD OF DISCLOSURE

The present disclosure relates to mobile devices, including but not limited to, keypad apparatus and methods.

BACKGROUND

Electronic devices, including portable electronic devices, have gained widespread use and may provide a variety of functions including, for example, telephonic, electronic messaging, and other personal information manager (PIM) application functions. Portable electronic devices include, for example, several types of mobile stations such as simple cellular telephones, smart telephones, wireless personal digital assistants (PDAs), and laptop computers with wireless 802.11 or Bluetooth capabilities.

Often these portable electronic devices include physical keyboards or keypads to input information. One benefit of a physical keypad is that it typically provides tactile feedback to a user. The tactile feedback from the keypad can be achieved in a variety of ways including the use of one or more collapsible dome switches associated with or corresponding to depressible keys of a keypad. To provide tactility, conventional keypads typically include a flexible or printed circuit board disposed between collapsible dome switches and a keypad support or tray (e.g., a housing).

Additionally, some keypads include a light source to illuminate the keys of the keypad to facilitate identification of the keys when using the portable electronic device in a dark environment with reduced visibility. A light guide film or panel is often used to deflect, reflect or channel light from a light source to illuminate the keypad. The light guide film is often placed over the dome switches. Thus, the light guide film typically has a convex or dome shape to accommodate for the shape or profile of the dome switches. For example, some conventional light guide films include a plurality of dome shaped surfaces to cover each dome switch of the keypad.

However, a dome shape light guide film provides a non-linear path through which light travels. In some instances, a non-linear light path due to the dome shape of the light guide film may cause light to be unevenly distributed, causing hotspots that receive too much light and dull spots that do not receive enough light to effectively illuminate the keypad. In some examples, the dome effect of the light guide film may cause light emitted from the light source to seep and erroneously highlight other keys of the keypad, thereby decreasing the effectiveness of the light guide film. Moreover, a light source having a greater intensity or luminance is often required due to the dome effect of the light guide film, thereby requiring more energy to power the light source. Further, the dome shaped light guide film significantly increases tactility restricting forces, thereby reducing the tactility of the keypad.

DETAILED DESCRIPTION

Figure 1:
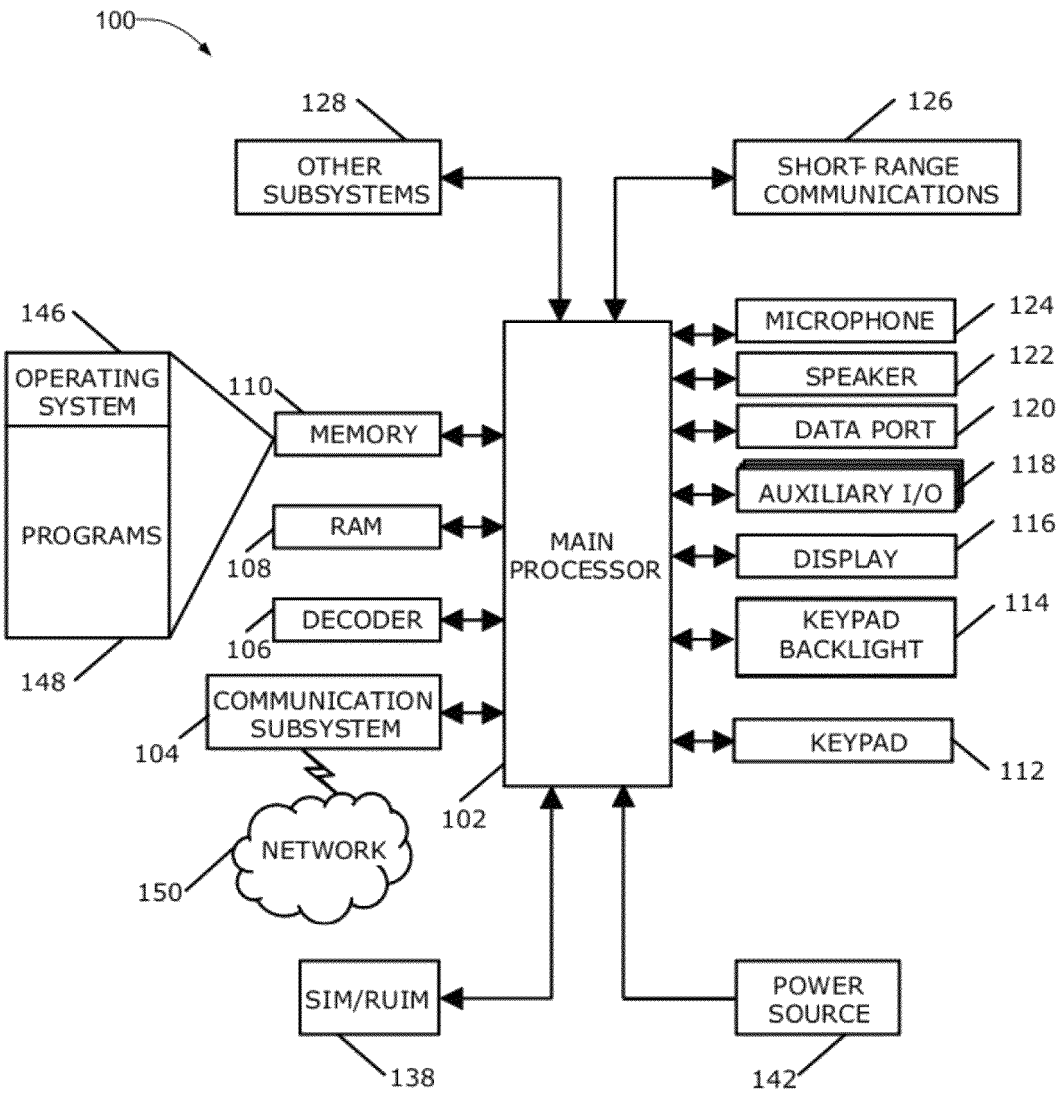
FIG. 1 is a block diagram of an example portable electronic device in accordance with the disclosure.

Example keypad apparatus and methods described herein significantly increase the luminance effectiveness of a keypad and significantly improve the keypad tactility. An example keypad described herein can be used to implement a portable electronic device such as, for example, a cellular device.

In general, an example keypad described herein employs a light guide film and/or a dome sheet carrier having relatively planar profiles, thereby substantially eliminating or removing a dome effect (e.g., a convex shape or hump) of the light guide film or panel and/or the dome sheet carrier. Removing the dome effect from a light guide film and/or a dome sheet carrier significantly improves the efficiency of the light guide film to diffuse, reflect or channel light from a light source toward a key of the keypad. As a result, an example light guide film significantly improves the luminance effectiveness of the keypad, thereby decreasing the amount of energy required to power a light source. For example, improving the luminance enables use of a light source having a lower intensity (e.g., wattage output). In turn, a light source with a lower intensity significantly improves the battery life of the portable electronic device. Additionally or alternatively, a substantially planar light guide film and/or dome sheet carrier provides a more substantially compact or flat keypad assembly resulting in a keypad assembly having a low profile or relatively small dimensional envelope.

Further, a substantially planar light guide film significantly reduces tactility restricting forces, thereby improving the tactility of the keypad. To provide tactile feedback and generate an electrical signal when a key of the keypad is activated, the keypad employs an electrical switch. An example electrical switch described herein includes one or more collapsible dome switches associated with or corresponding to depressible keys of a keypad and contacts of a printed circuit board. For example, the dome switch collapses toward the contact of the printed circuit board to generate an electrical signal when a key is activated.

For the purpose of enabling use of a substantially planar light guide film, at least a portion of an example printed circuit board described herein is positioned or nested in a cavity or recessed well of a keypad support or housing. In particular, an example printed circuit board described herein includes at least one tab or portion that is movable or repositionable relative to a first or substantially planar surface or panel of the printed circuit board. In this manner, the repositioned portion can be located in the cavity of the tray and the panel or relatively planar surface can be located on a first or upper surface of the tray when the printed circuit board is coupled to the tray.

For example, an example printed circuit board may include a plurality of tabs corresponding to each key of a keypad. The tabs are integrally formed with, or permanently attached to, the panel of the printed circuit board and are supported by hinges, which enable the tabs to be positioned in an offset relationship relative to the panel of the printed circuit board. Each of the tabs supports a contact of the electrical switch corresponding to one of the respective keys. Thus, a contact of the printed circuit board is positioned in the cavity while the panel of the printed circuit board engages the first or upper surface of the tray.

Additionally, the dome switch is also at least partially positioned or nested within the cavity of the tray such that the dome switch provides a low profile. Such a configuration enables use of a light guide film and/or a dome sheet carrier to have a relatively planar profile or flat surface relative to the keypad support and/or the printed circuit board. In other words, unlike conventional keypad assemblies which often include a curved surface or dome shape to accommodate for a dome switch, example light guide films described herein do not have dome or curved profiles or shapes because the dome switch and/or the contact of the printed circuit board are at least partially positioned or lowered within a cavity of the tray. As a result, example light guide films described herein provide a relatively straight light travel path, thereby improving the luminance of the keypad apparatus and, thus, decreasing the amount of light required to illuminate the keypad apparatus.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the examples described. The description is not to be considered as limited to the scope of the examples described herein.

The disclosure generally relates to electronic devices such as, for example, a portable electronic device in the examples described herein. Examples of portable electronic devices include mobile, or handheld, wireless communication devices such as pagers, cellular phones, cellular smartphones, wireless organizers, personal digital assistants, wirelessly enabled notebook computers, and so forth. The portable electronic device may also be a portable electronic device without wireless communication capabilities, such as a handheld electronic game device, digital photograph album, digital camera, or other device.

A block diagram of an example of a portable electronic device 100 is shown in FIG. 1. The portable electronic device 100 includes multiple components, such as a processor 102 that controls the overall operation of the portable electronic device 100. Communication functions, including data and voice communications, are performed through a communication subsystem 104. Data received by the portable electronic device 100 is decompressed and decrypted by a decoder 106. The communication subsystem 104 receives messages from and sends messages to a wireless network 150. The wireless network 150 may be any type of wireless network, including, but not limited to, data wireless networks, voice wireless networks, and networks that support both voice and data communications. A power source 142, such as one or more rechargeable batteries or a port to an external power supply, powers the portable electronic device 100.

The processor 102 interacts with other components, such as Random Access Memory (RAM) 108, memory 110, a keypad 112, a keypad backlight system 114, a display 116, an auxiliary input/output (I/O) subsystem 118, a data port 120, a speaker 122, a microphone 124, short-range communications 126, and other device subsystems 128. User-interaction with a graphical user interface is performed through the display 116. Information, such as text, characters, symbols, images, icons, and other items that may be displayed or rendered on a portable electronic device, is presented on the display 116 via the processor 102.

To identify a subscriber for network access, the portable electronic device 100 uses a Subscriber Identity Module or a Removable User Identity Module (SIM/RUIM) card 138 for communication with a network, such as the wireless network 150. Alternatively, user identification information may be programmed into memory 110.

The portable electronic device 100 includes an operating system 146 and software programs or components 148 that are executed by the processor 102 and are typically stored in a persistent, updatable store such as the memory 110. Additional applications or programs may be loaded onto the portable electronic device 100 through the wireless network 150, the auxiliary I/O subsystem 118, the data port 120, the short-range communications subsystem 126, or any other suitable subsystem 128.

A received signal such as a text message, an e-mail message, or web page download is processed by the communication subsystem 104 and input to the processor 102. The processor 102 processes the received signal for output to the display 116 and/or to the auxiliary I/O subsystem 118. A subscriber may generate data items, for example e-mail messages, which may be transmitted over the wireless network 150 through the communication subsystem 104. For voice communications, the overall operation of the portable electronic device 100 is similar. The speaker 122 outputs audible information converted from electrical signals, and the microphone 124 converts audible information into electrical signals for processing.

Figure 2:
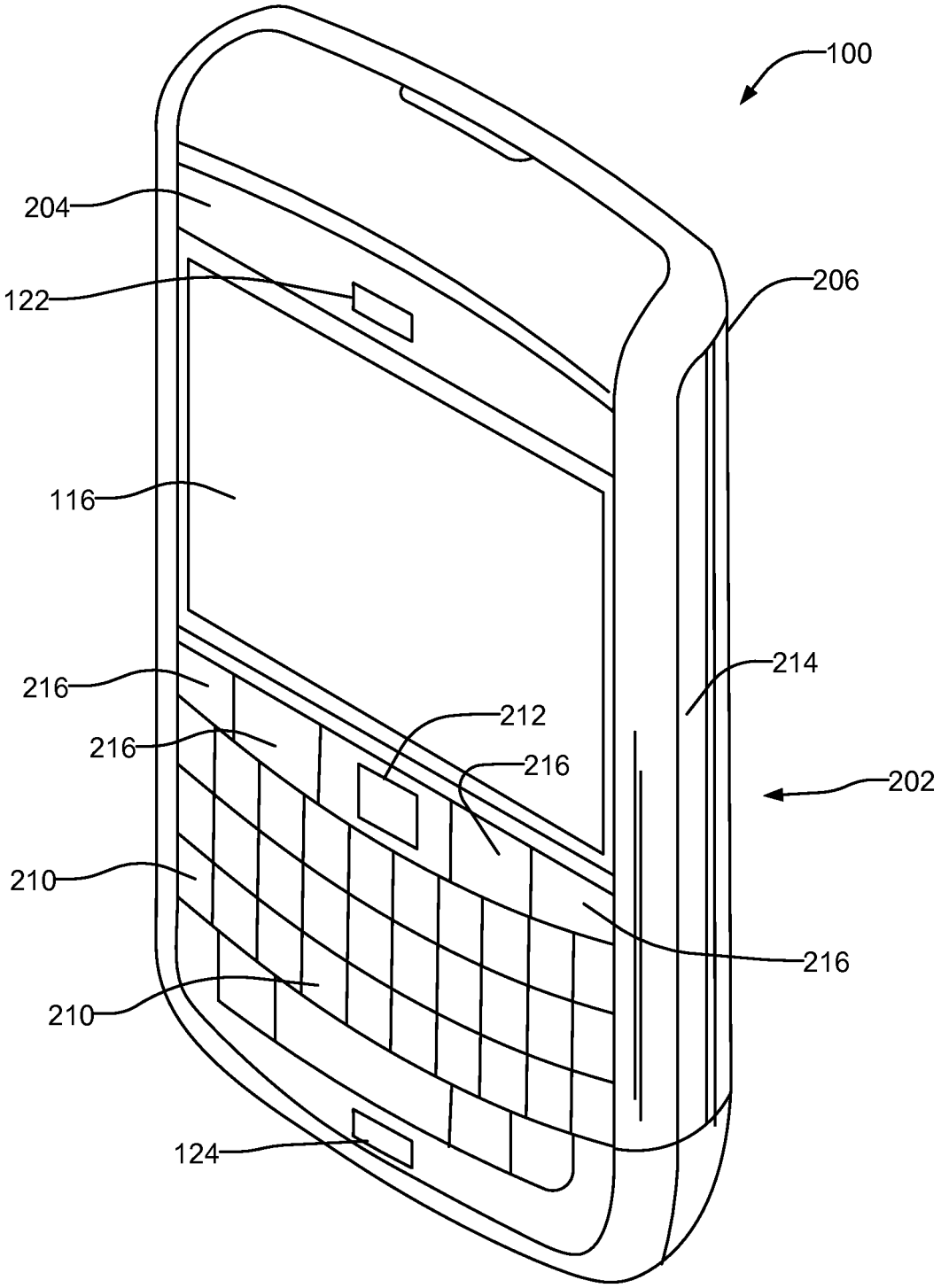
FIG. 2 is an example portable electronic device of FIG. 1 implemented with an example keypad described herein.

FIG. 2 is a perspective view of the portable electronic device 100 of FIG. 1. In the example of FIG. 2, the portable electric device 100 is a handheld communication device or mobile phone. As mentioned above, the electronic device may be a data and/or voice-enabled handheld device that may be used to send and receive a message, a voice communication, a textual entry, etc. Referring to FIG. 2, the electronic device 100 includes a housing 202 that encloses the electronic or mobile components described above in connection with FIG. 1. For example, the housing 202 encloses the microprocessor 102, the display 116, the keypad 112, the speaker 122, the microphone 124, etc. The housing 202 may include a front cover or lid 204 that couples to a frame or base 206 to capture the electronic components within the housing 202. The housing 202 of the illustrated example can be held in one hand by a user of the electronic device 100 during data (e.g., text) and/or voice communications.

In the example of FIG. 2, the display 116 is located adjacent or above the keypad 112. To provide a user input and accommodate textual inputs to the electronic device 100, the keypad 112 includes a plurality of keys or key switch assemblies 210. The keys 210 enable character inputs including alphabetical and/or numeric entries to allow text and/or numeric entry for various functions. For example, the keypad 112 may be QWERTY style keypad or any other suitable type keypads.

Further, the keypad 112 of the illustrated example includes an auxiliary input 212 that provides a cursor or navigation tool. In addition to being used as a cursor or navigation tool, the auxiliary input 212 can act as an actuator when the auxiliary input 212 is depressed like a button. The auxiliary input 212 may be a trackpad, a trackball, a touch pad, etc. Although in this example the auxiliary input 212 is disposed between the display 116 and the keys 210, the auxiliary input 212 may be disposed on any surface of the housing 202 such as, for example, a side surface 214. In this example, the electronic device 100 also includes action keys 216 adjacent the auxiliary input 212. For example, the action keys 216 may include an on/off button or call end button, a call send button, a menu button, an escape key, etc.

A user interacts with the electronic device 100 via the keys 210, the auxiliary input 212 and/or the function keys 216 of the keypad 112 to choose commands, execute application programs, and perform other functions by selecting menu items or icons. Additionally or alternatively, in other examples, the electronic device 100 may include a touch screen display. In combination with the keypad 112, a user may interact with the electronic device 100 via the touch screen display to choose commands, execute application programs, and perform other functions by selecting menu items or icons by contacting or touching the icon or image via the touch screen. Further, in other examples, the auxiliary input 212 and the function keys 216 may be disposed on an upper housing of an electric device that moves relative to a lower housing of the electric device, where the keypad 212 is disposed within the lower housing and the display 116 or touch-sensitive display is disposed within the upper housing (not shown).

Figure 3A:
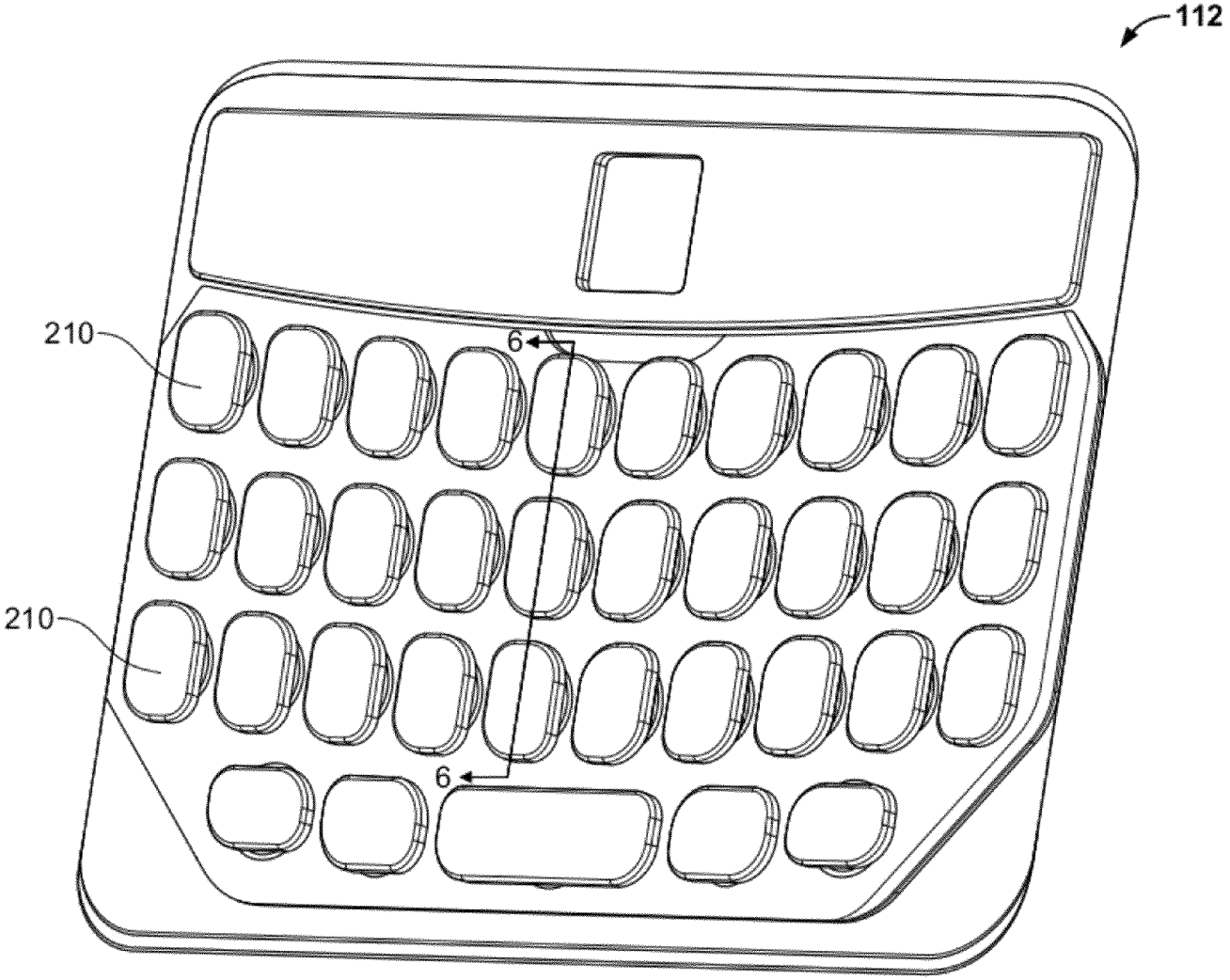
FIG. 3A is an assembly view of the example keypad of FIGS. 1 and 2.
Figure 3B:
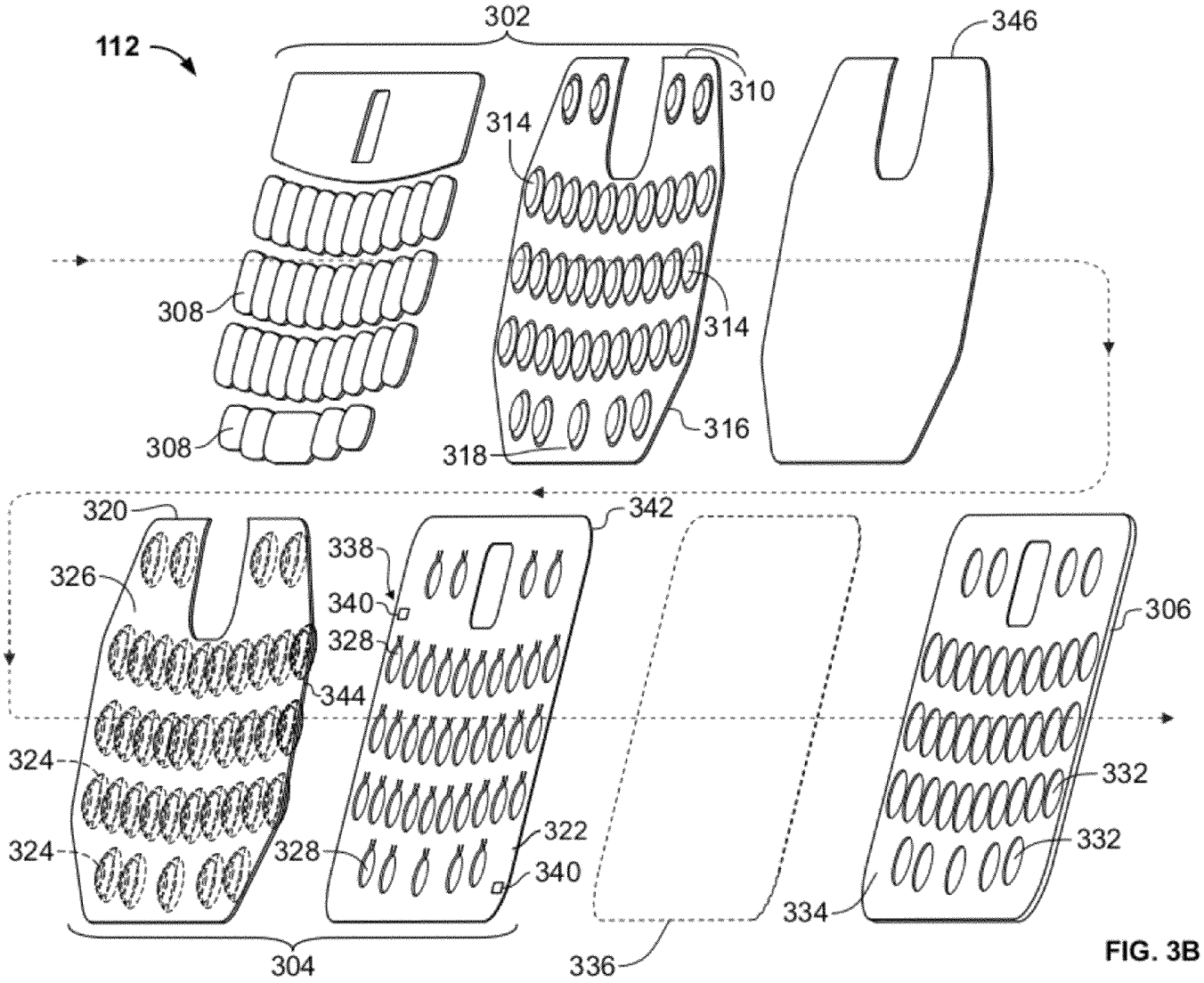
FIG. 3B is an exploded view of the example keypad of FIG. 3A.

FIG. 3A illustrates a perspective, assembly view of the example keypad 112 of FIGS. 1 and 2. FIG. 3B illustrates an exploded view of the example keypad of FIGS. 1 and 2. Referring to FIGS. 3A and 3B, the keypad 112 is a backlit keypad that is illuminated via the keypad backlight system 114 of FIG. 1. In particular, the keys 210 are illuminated to facilitate identification of the keys 210 when using the portable electronic device 100 in a dark environment with reduced visibility.

As most clearly shown in FIG. 3B, the keypad 112 of the illustrated example includes an actuator assembly 302 positioned above or over an electrical switch 304. The actuator assembly 302 is operatively coupled to the electrical switch 304 and interacts with the electrical switch 304 to generate an electrical signal when a user depresses one of the respective keys 210. To support the actuator assembly 302 and the electrical switch 304, the keypad 112 includes a keypad support or tray 306.

The actuator assembly 302 of the illustrated example includes a plurality of keycaps 308 and a keyweb or rubber pad 310. In this example, each of the keycaps 308 corresponds to respective ones of the keys 210 shown in FIG. 2. To enable backlighting of the keys 210 or keycaps 308, at least some of the keycaps 308 include a transparent or translucent region to enable light to emit therethrough and an opaque region to restrict or impede light from being emitted therethrough. For example, although not shown, the keycaps 308 include indicia or graphics representing different (e.g., alphanumeric) character inputs. The graphic portion or indicia of the keycaps 308 may be composed of a transparent or translucent material or layer (or a semi-transparent or semi-translucent material) and a non-graphic portion of the keycaps 308 may be composed of an opaque material or layer. For example, to provide the translucent region, indicia on the keycaps 308 may be formed by removing (e.g., via laser etching) an outer layer of opaque material to expose a translucent material underneath the opaque layer. The keycaps 308 are composed of a relatively thin molded plastic or composite material and the transparent regions may be white, clear and/or any other color(s).

In the illustrated example, the keyweb 310 is a rubber layer that includes a plurality of plungers, actuators or dome shaped members 314 that are interconnected via a rubber sheet 316. In the illustrated example, each actuator 314 protrudes from a surface 318 of the rubber sheet 316, and each actuator 314 is associated with respective ones of the keycaps 308. However, in other examples, at least some of the actuators 314 may be associated with two or more keycaps 308 or keys 210. The keyweb 310 may be composed of an opaque and/or translucent material such as, for example, rubber or silicone or any other suitable material(s), and may be formed as a unitary sheet or structure via, for example, vacuum molding or any other suitable manufacturing process(es). Alternatively, in some examples, the keycaps 308 and the keyweb 310 may be integrally formed as a unitary piece or structure.

The electrical switch 304 of the illustrated example includes a dome sheet 320 that is positioned above a printed circuit board 322 (e.g., a flexible printed circuit board). The dome sheet 320 includes a plurality of dome switches 324 that protrude away from the dome sheet 320 toward the printed circuit board 322. As shown in FIG. 3B, the number of dome switches 324 corresponds to the number of actuators 314 or keys 210, such that each key 210 is associated with a single dome switch 324. The dome switches 324 are provided in a grid pattern and are spaced (e.g., evenly, unevenly, etc.) relative to one another and are aligned with the respective ones of the actuators 314 and the keycaps 308. Alternatively, more than one key 210 may be associated with each dome switch 324 and a predictive text or other software program or hardware may be utilized to determine the desired text. In those examples, the dome switches 324 may be offset relative to the actuators 314 and/or the keycaps 308.

In the illustrated example, the dome switches 324 are elastically deflectable between a relaxed position and a deflected position. In this example, the domes are metal springs composed of, for example, a thin plate-like metallic material and are formed into a dome-like shape and act as a conductor. Each of the dome switches 324 may be formed by a tact spring having elasticity that snaps when pressed to provide a tactile feedback to a user. In this example, the dome switches 324 are integrally formed with the dome sheet 320. A dome sheet carrier 326 (e.g., a thin film) is disposed over the dome sheet 320 and the dome switches 324. The dome sheet carrier 326 may be, for example, polyester or plastic material (e.g. Mylar®) or any other transparent or semi-transparent resinous film.

As described in greater detail below in connection with FIG. 4, at least a portion of the printed circuit board 322 is repositionable relative to a first or relatively planar surface or panel 330 of the printed circuit board 322. As shown in FIG. 3B, the printed circuit board 322 includes one or more tabs or repositioned portions 328 that are repositioned or relocated (e.g., hang) relative to the upper, substantially planar surface or panel 330 of the printed circuit board 322. As shown in FIG. 3B, the number of tabs 328 corresponds to the number of dome switches 324 such that each tab 328 is associated with a single dome switch 324. Although not shown in FIG. 3B for clarity, the printed circuit board 322 includes a plurality of traces that electrically couple a contact member or a flex disposed on each tab 328 and the processor 102. An example trace of the printed circuit board 322 is described below in connection with FIG. 4B.

As noted above, the tray 306 supports the printed circuit board 322. The tray 306 has one or more pockets, recessed wells or cavities 332 formed in a first or upper surface 334 (e.g., a front surface) of the tray 306. When the printed circuit board 322 is coupled to the tray 306, each of the tabs 328 of the printed circuit board 322 is at least partially disposed, encased, surrounded, nested or otherwise positioned in the respective ones of the cavities 332. In other words, the tabs 328 are repositioned relative to the panel 330 so that the tabs 328 are located in the respective cavities 332 and the panel 330 is located on the upper surface 334 of the tray 306 when the printed circuit board 322 is coupled to the tray 306. The tray 306 of the illustrated example is a uniform structure that may be composed of plastic, magnesium, metal or any suitable material. In other examples, the tray 306 may be a printed circuit board. An adhesive 336 (e.g., an adhesive sheet) may be employed to couple or retain the printed circuit board 322 and the tray 306. For example, the adhesive 336 may be an adhesive film that is disposed between the printed circuit board 322 and the tray 306.

To provide a backlighting to the keypad 112, the electrical switch 304 includes a light source 338. The light source 338 may be mounted (e.g., surface mounted) to the panel 330 of the printed circuit board 322. In this example, the light source 338 includes one or more light emitting diodes 340 ("LEDs") that are side mounted on the printed circuit board 322. In this particular example, the LEDs 340 are mounted adjacent a peripheral edge 342 of the printed circuit board 322 such that the dome sheet 320 does not interfere or block light emitted by the LEDs 340 when the dome sheet 320 is coupled to the printed circuit board 322. In some examples, the dome sheet 320 is dimensioned so that there is a space or gap between a peripheral edge 344 of the dome sheet 320 and the LEDs 340 when the dome sheet 320 is coupled to the printed circuit board 322. In other examples, the dome sheet 320 may include an aperture to receive the light source 338.

To diffuse, reflect or channel light emitted by the light source 338 to the keycaps 308, the keypad 122 employs a light guide film 346. The light guide film 346 is a relatively thin backlighting member or panel that diffuses and/or redistributes light from the light source 338. In the illustrated example, the light guide film 346 is disposed between the keyweb 310 and the dome sheet 320 and is in direct optical communication with the light source 338. Unlike conventional light guide films, the light guide film 346 of the illustrated example has a generally planar or flat profile or shape. In other words, the light guide film 346 does not have a dome shape or profile to accommodate the dome switches 324, thereby improving luminance by providing a substantially straight and/or a more efficient travel path for the light emitted by the light source 338.

To further increase the effectiveness or efficiency of light transmission, a surface of the light guide film 346 in communication with the light source 338 may include a reflective pattern. For example, the reflective pattern may include a non-smooth, angled or uneven pattern. Additionally, the reflective pattern may vary across different portions of the light guide film 346. For example, a reflective pattern provided below the keys 210 that are relatively close to the light source 338 may have a different density or size (e.g., a lower density) than a density or size (e.g., a higher density) of a reflective pattern provided below the keys 210 relatively remote from the light source 338. In this manner, the reflective patterns provide a more uniform distribution of light regardless of the distance (e.g., a lateral or horizontal distance) between the keys 210 and the light source 338.

In addition to providing light diffusing characteristics, the light guide film 346 has elasticity to flex, bend or deflect in the region corresponding to a respective key 210 that is activated. Further, the light guide film 346 restores to its original state upon release of the key 210. The light guide film 346 may be composed of a transparent or semi-transparent material having low hardness, high elastic strain such as, for example, acrylic, polycarbonate, polyethylene (PET), silicone or any other suitable flexible material(s) that channel or diffuse light emitted from the light source 338. The light guide film 346 may be formed via injection molding or any other suitable manufacturing process(es).

Figure 4A:
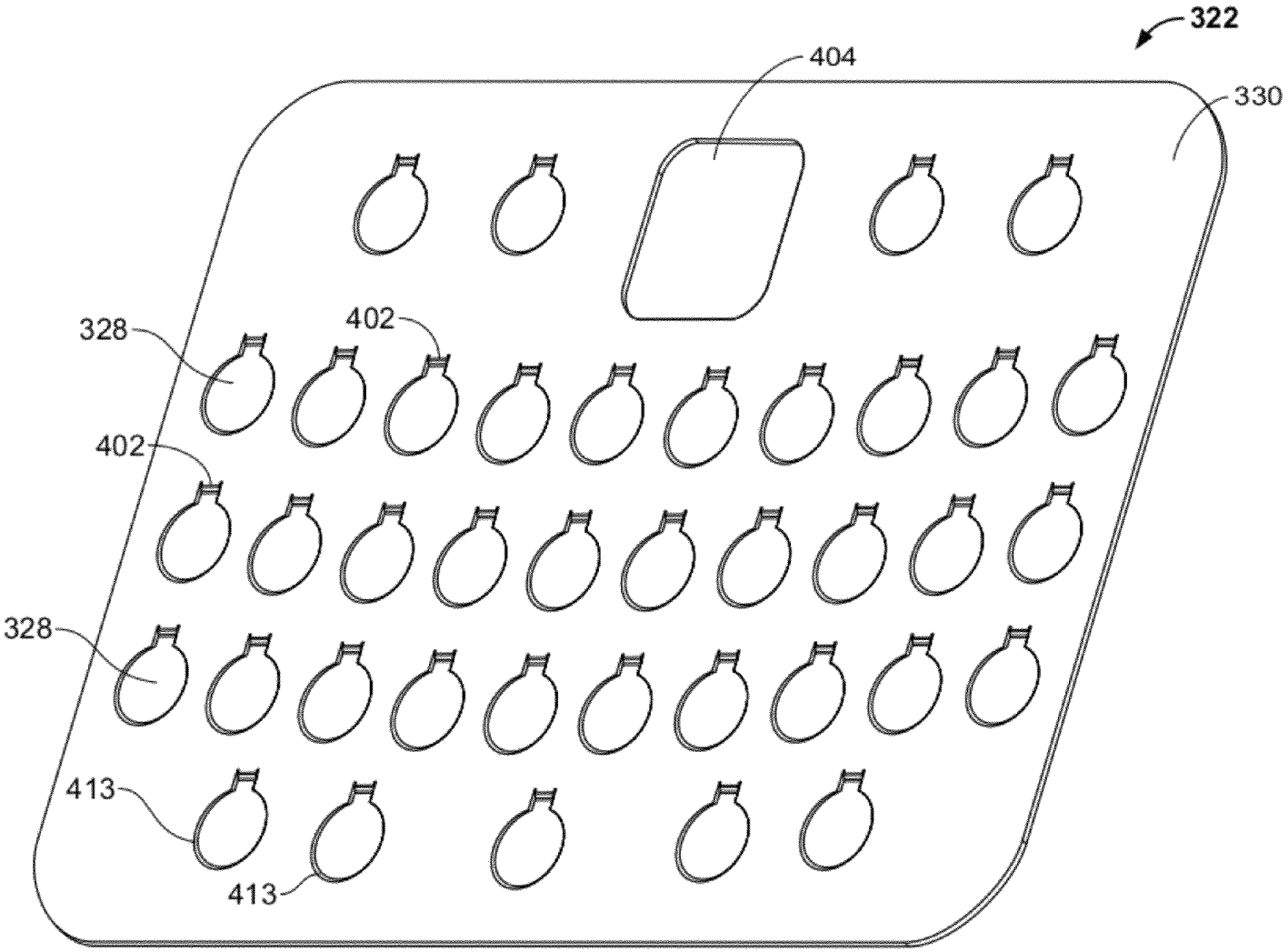
FIG. 4A is a perspective view of an example printed circuit board described herein of the example keypad of FIGS. 1, 2, 3A and 3B.

FIG. 4A illustrates the example printed circuit board 322 of FIGS. 3A and 3B. FIG. 4B is an enlarged view of a portion of the example printed circuit board 322 of FIG. 4A. As shown in FIG. 4A, each tab or repositioned portion 328 is flexibly or hingably coupled or joined to the panel 330 of the printed circuit board 322. As shown, a strip or hinge 402 attaches (e.g., permanently attaches) the tabs 328 to the panel 330 of the printed circuit board 322. In this example, the tabs 328 and the hinges 402 are integrally formed with the panel 330 of the printed circuit board 322 as a uniform piece or structure. Although the tabs 328 are attached to the panel 330 of the printed circuit board 322, the tabs 328 can be moved or repositioned relative to the panel 330 of the printed circuit board 322. More specifically, the hinge 402 enables the tabs 328 of the printed circuit board 322 to bend, flex or otherwise move relative to the panel 330 such that the tabs 328 can be repositioned or offset relative to the panel 330 of the printed circuit board 322. In this manner, the tabs 328 may be depressed or lowered in the cavities 332 of the tray 306.

To form the tabs 328 and the hinge 402, a portion of material of the panel 330 about a partial perimeter or edge (e.g., adjacent or up to the hinge 402) of the tab 328 is removed from the panel 330 of the printed circuit board 322. For example, after the printed circuit board 322 is formed (e.g., formed with traces and conductive contacts), the printed circuit board 322 may undergo a secondary manufacturing operation or process(es) to form the tabs 328. For example, to form the tabs 328, the panel 330 may be punched, cut by a laser, etc., to partially remove a portion of the material adjacent a partial peripheral edge or perimeter of each of the tabs 328. When the tabs 328 are punched or otherwise formed via any other suitable manufacturing process(es), partial openings 413 are formed in the panel 330 of printed circuit board 322 when the tabs 328 are repositioned or moved relative to the panel 330. In other words, the tabs 328 occupied the partial openings 413 of the panel 330 prior to moving or repositioning the tabs 328 relative to the panel 330.

As shown, the tabs 328 have a partial or semi-circular shape or profile. However, in other examples, the tabs 328 may have a partial square shape or any other suitable shape or profile. In yet other examples, the printed circuit board 322 may include one large tab (e.g., a rectangular tab) having a plurality of contacts corresponding to respective ones of the dome switches 324 (FIG. 3B). Also, as shown in FIG. 4A, the printed circuit board 322 includes an electrical switch or sensor 404 associated with the auxiliary input 212 of FIG. 2.

Figure 4B:
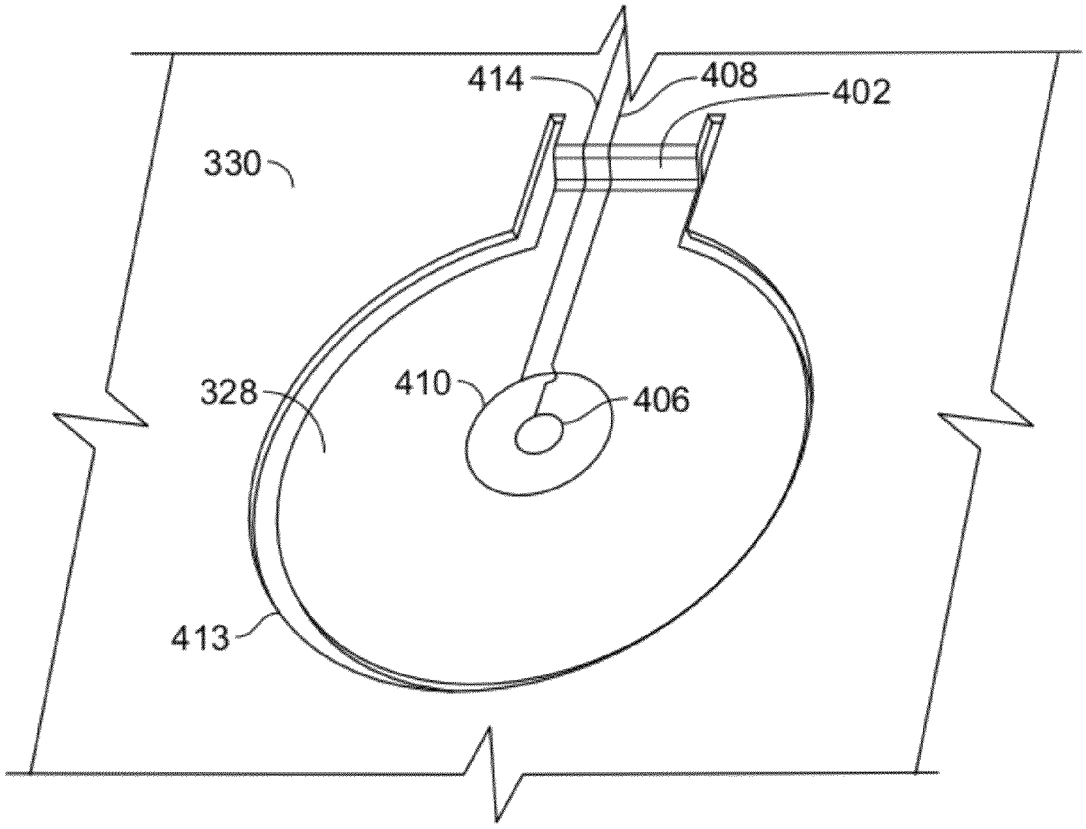
FIG. 4B is an enlarged view of a portion of the printed circuit board of FIG. 4A coupled to an example keypad support described herein.

Also, referring to FIG. 4B, each of the tabs 328 includes or supports an electrical conductive contact 406 (e.g., an electrode) that is coupled to the processor 102 via a trace 408. Although not shown in FIG. 4B, the dome switch 324 is positioned or aligned on the tab 328 such that an outer peripheral edge or surface of the dome switch 324 engages an outer contact 410, which is coupled to the processor 102 via a trace 414. Both of the traces 408 and 414 are provided along the hinge 402.

Figure 5:
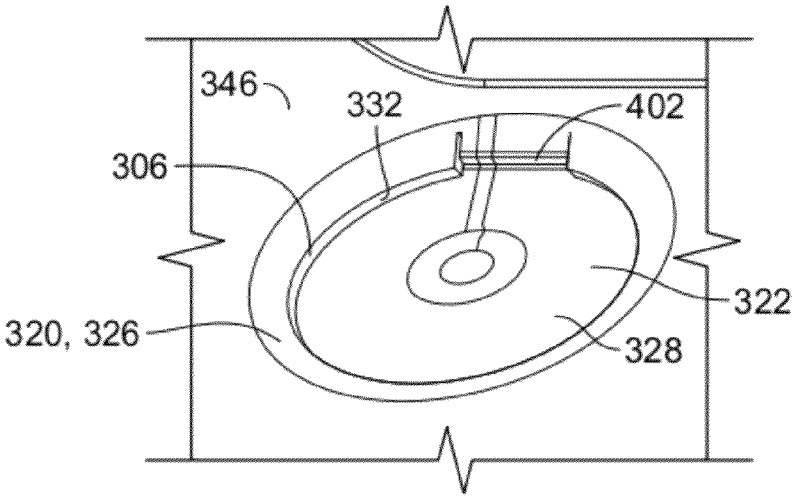
FIG. 5 is a partially, enlarged assembly view of the example keypad described herein showing an example light guide film described herein of the example keypad coupled to the printed circuit board and the support of FIG. 4A.

FIG. 5 is an enlarged view of the tab 328 of FIG. 4B, but showing a partial cutaway view of the light guide film 346 coupled to the dome sheet 320, which is coupled to the printed circuit board 322. For clarity, the dome switch 324 associated with the tab 328 of the illustrated example of FIG. 5 is not shown in FIG. 5. When coupled to the printed circuit board 322, the light guide film 346 and the dome sheet carrier 326 are substantially flat or parallel relative to the panel 330 of the printed circuit board 322 and/or the upper surface 334 of the tray 306. In this manner, the electrical switch 304 (e.g., the dome switch 324 and the tab 328) provides a low profile or dimensional envelope.

Figure 6:
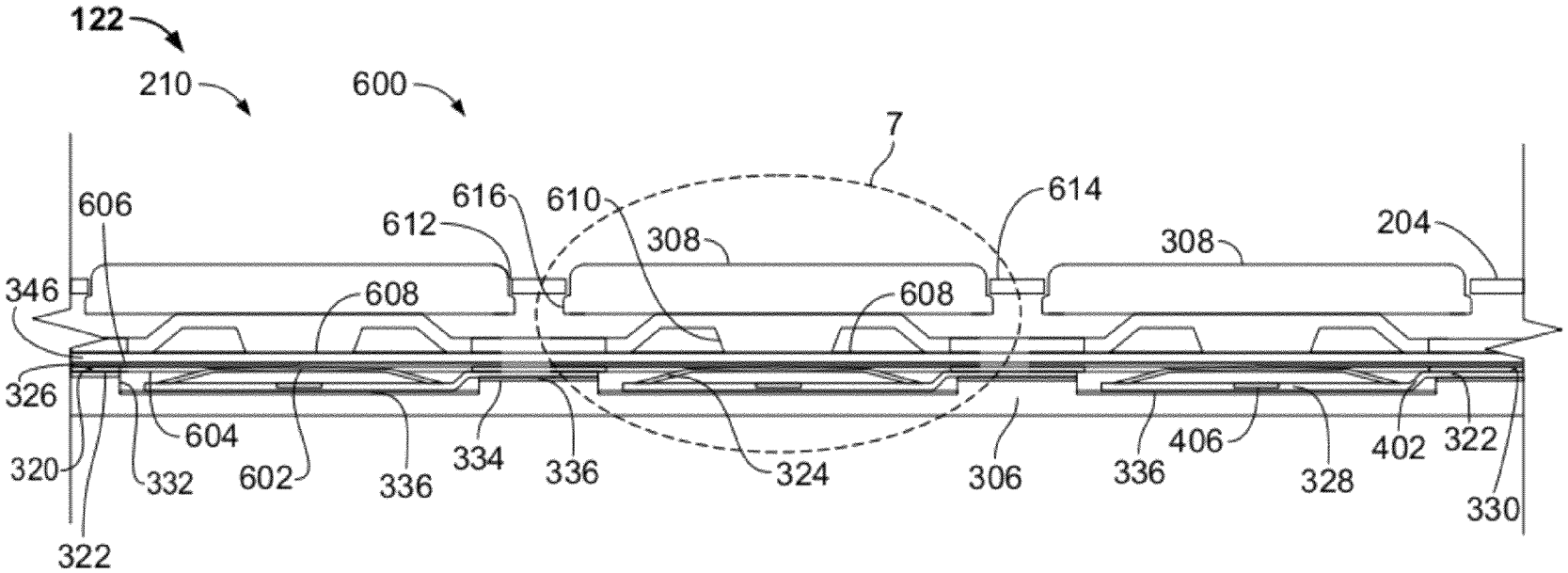
FIG. 6 is a portion of a row of the example keypad of FIGS. 1, 2, 3A, 3B, 4A, 4B, and 5.

FIG. 6 is a cross-sectional view of a partial row 600 of the example keypad 122 taken along line 6-6 of FIG. 2. To assemble the keypad 112, the adhesive 336 is applied (e.g., uniformly) to the upper surface 334 of the tray 306. To secure the tabs 328 of the printed circuit board 322 to the tray 306, the adhesive 336 is also positioned within the cavities 332 of the tray 306. The panel 330 of the printed circuit board 322 is adhered or coupled to the upper surface 334 of tray 306 and the tabs 328 are repositioned relative to the panel 330 of the printed circuit board 322 so that the tabs 328 are depressed or nested or otherwise positioned in the cavities 332 while the panel 330 is positioned on the upper surface 334 of the tray 306. When coupled to the tray 306, the hinges 402 keep the tabs 328 joined or connected to the panel 330 of the printed circuit board 322.

The dome sheet 320 is then coupled to the panel 330 of the printed circuit board 322 such that the dome switches 324 are at least partially lowered or nested within the respective cavities 332 of the tray 306. The dome switches 324 are positioned above or on top of the tabs 328 so that a conductive contact surface 602 (e.g., an apex) of the dome switch 324 is aligned relative to the conductive contact 406 of the respective tabs 328. In some examples, the contact surface 602 of the dome switch 324 may be implemented with a contact member or electrode. As shown, when the dome sheet 320 is coupled to the printed circuit board 322 and the tray 306, a first or upper surface 606 of the dome sheet carrier 326 is relatively planar or parallel with the panel 330 of the printed circuit board 322 because the dome switches 324 protrude from a lower surface 604 of the dome sheet 320 and are at least partially disposed in the respective cavities 332. An adhesive or other fastener(s) may be employed to secure the dome sheet 320 to the panel 330 of the printed circuit board 322.

The light guide film 346 is then coupled to the upper surface 606 of the dome sheet carrier 326. Also, because the dome switches 324 are at least partially disposed within the cavities 332, the light guide film 346 also has a relatively flat or planar profile when assembled with the keypad 112. The keyweb 310 is coupled to an upper surface 608 of the light guide film 346 such that a cylindrically-shaped plunger 610 of each of the actuators 314 engages the upper surface 608 of the light guide film 346. Thus, the light guide film 346 operatively couples the actuator assembly 302 to the electrical switch 304. The keycaps 308 are positioned or aligned with respective ones of the plungers 610.

When assembled with the housing 202, each of the keycaps 308 is positioned within an opening 612 of the front cover 204 and projects from a front surface 614 of the front cover 204. Further, the front cover 204 engages a lip or flange 616 of the keycaps 308 to retain the keycaps 308 aligned within the housing 202 and the respective plungers 610.

Figure 7:
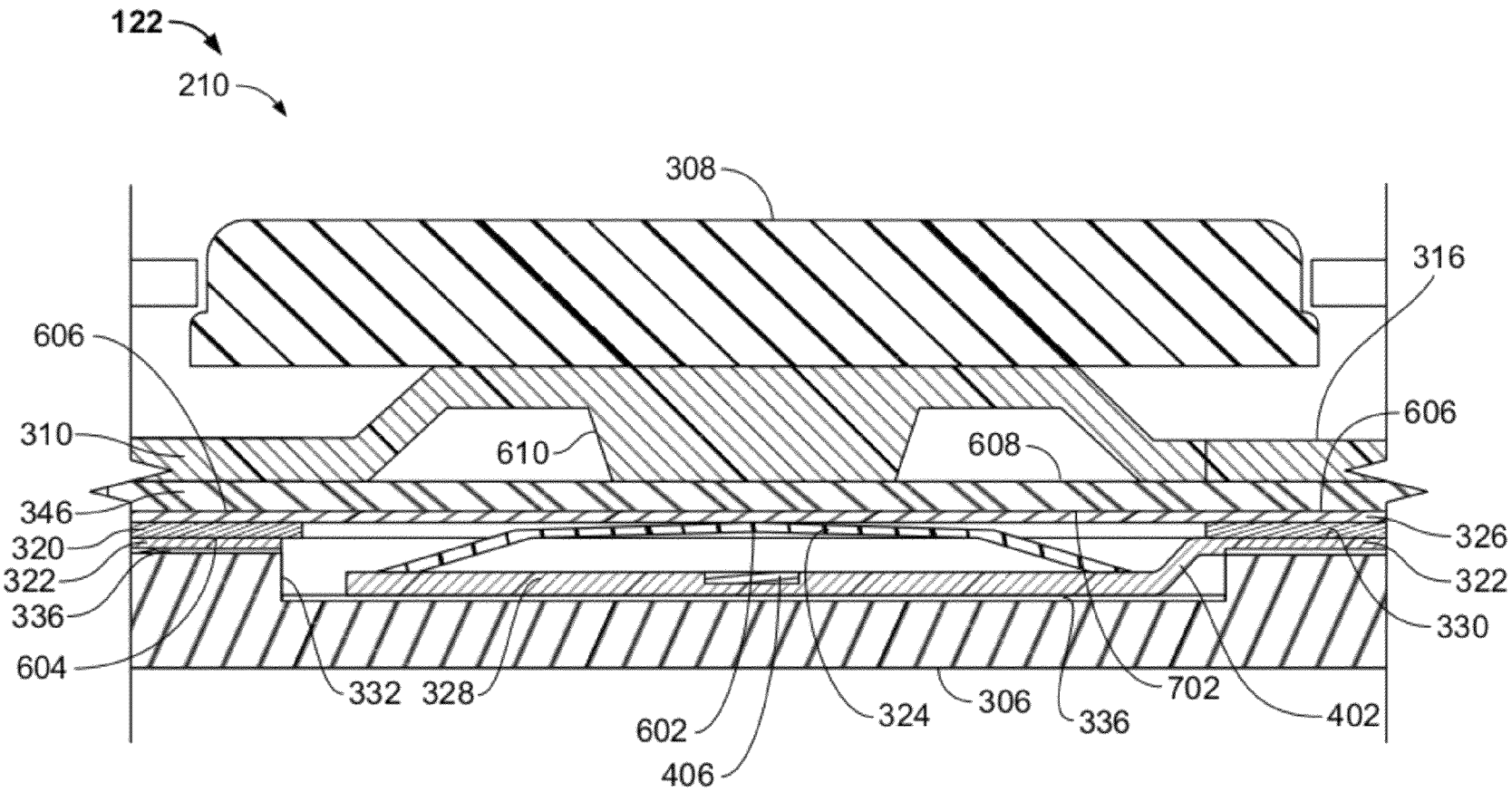
FIG. 7 is an enlarged cross-sectional view of a key of the keypad of FIG. 6.

FIG. 7 is an enlarged view of a key 210 of the example keypad 122 of FIG. 6. In operation, the key 210 moves between an actuated position (not shown) to activate the electrical switch 304 and generate an electrical signal and a non-actuated position in which the electrical switch 304 is deactivated. The plunger 610 of the keyweb 310 provides stiffness to hold the keycap 308 in position when the key 210 is not pressed or actuated. On the other hand, a user can exert downward force on the keycap 308 to depress the key 210 with relative ease. The force required to press the key 210 is large enough that the person can feel a resistance to the pressure of their finger on the keys 210.

To activate the key 210, a user depresses the keycap 308 to provide data input to the electronic device 100. In particular, the electrical switch 304 generates an output signal that is received by the processor 102 when the key 210 is depressed by a user. For example, when a user presses the keycap 308, the plunger 610 moves toward the tray 306. The plunger 610 presses against the upper surface 608 of the light guide film 346 to cause the light guide film 346 to deflect, flex or bend toward the dome switch 324 to press or deflect the dome switch 324. In turn, the dome switch 324 collapses toward the tab 328. The contact surface 602 of the dome switch 324 engages the conductive contact 406 of the tab 328 of the printed circuit board 322 thereby closing an electrical circuit and generating an electrical signal that is received or detected by the processor 102.

When a user releases the keycap 308 to deactivate the key 210, the rubber plunger 610 returns to its original position or state. The light guide film 346 returns to its original state and releases the dome switch 324. The dome switch 324 also snaps back to its original or dome shaped position as shown in FIG. 7. The dome switch 324 provides a tactile feedback (e.g., a force) to the user when the dome switch 324 snaps back to its original position.

Additionally or alternatively, to provide backlighting to the keypad 112, the light source 338 emits a light (e.g., a white light, a colored light, etc.). The light emitted by the light source 338 is in direct optical communication with a lower surface 702 of the light guide film 346. The light travels through and/or is reflected, diffused, guided or channeled through the lower surface 702 of the light guide film 346. The lower surface 702 of the light guide film 346 may include a reflective pattern to more evenly distribute or diffuse the light across the keypad 112. Light leakage between the light guide film 346 and the printed circuit board 322 is substantially eliminated because there is no gap between the light guide film 346 and the printed circuit board 322. Instead, the light guide film 346 diffuses or reflects light emitted by the light source 338 between the lower surface 702 and the upper surface 608 and toward the keycap 308. The light diffused by the light guide film 346 then passes through the keyweb 310 (e.g., the plunger 610) and to the keycap 308, thereby illuminating the keypad 112 so that the electronic device 100 can be used in dark locations.

The light guide film 346 provides a relatively small restrictive light travel path because both the respective upper and lower surfaces 608 and 702 of the light guide film are relatively flat, thereby creating a substantially straight and efficient travel path for the light. As a result, the light guide film 346 diffuses light with greater efficiency and effectiveness compared to a conventional light guide film that is implemented with curved surfaces to accommodate a dome switch. Thus, the light guide film 346 diffuses light more effectively and/or efficiently.

As a result, the light guide film 346 of the illustrated example significantly improves the luminance of the keypad 112, thereby decreasing the amount of energy required to power the light source 338 because a light source having a lower intensity (e.g., wattage output) can be used. Using a lower intensity light provides a power saving. Additionally or alternatively, the light source 338 may be implemented with a fewer number of LEDs 340.

Furthermore, the relatively flat light guide film 346 significantly reduces tactility restricting forces, thereby improving the tactility feedback of the keys 210. Additionally or alternatively, providing a substantially flat light guide film 346

(and at least partially nesting the dome switches 324 within the cavities 332) provides a more compact keypad 112 having a low profile or relatively small dimensional envelope.

The methods described herein may be carried out by software executed, for example, by the processor 102. Coding of software for carrying out such a method is within the scope of a person of ordinary skill in the art given the present description. A computer-readable medium having computer-readable code may be executed by at least one processor of the portable electronic device 100 to perform the methods described herein.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. A keypad assembly comprising:

a printed circuit board having a tab integrally formed with a panel of the printed circuit board, the tab being movable relative to the panel of the printed circuit board to enable the tab to be positioned in an offset relationship relative to the panel of the printed circuit board, and wherein the tab supports a conductive contact of the printed circuit board;

a tray to couple to the printed circuit board, wherein the tray defines a cavity formed in a first surface of the tray; and a dome switch at least partially disposed in the cavity and substantially aligned with the tab, wherein the dome switch is coupled to a dome sheet and a dome sheet carrier.

2. The keypad assembly of claim 1, wherein the dome sheet carrier engages the panel of the printed circuit board when the dome switch is disposed in the cavity, and wherein the dome sheet carrier is substantially planar.

3. The keypad assembly of claim 2, further comprising a light guide film disposed above the dome sheet carrier, wherein the light guide film is substantially planar.

4. The keypad assembly of claim 3, further comprising a light source in optical communication with the light guide film, wherein the light guide film is to deflect or channel the light emitted by the light source toward a keycap of the keypad assembly to illuminate the keypad assembly.

5. A method for assembling a keypad, the method comprising:

providing a flexible printed circuit board having at least one trace and at least one conductive contact disposed on a relatively planar surface;

forming a tab in the planar surface of the flexible printed circuit board, wherein the tab supports the conductive contact and the at least one trace;

repositioning the tab of the flexible printed circuit board in an offset relationship relative to the planar surface of the flexible printed circuit board; and locating the repositioned tab in a cavity of a tray and locating the planar surface on an upper surface of the tray, wherein the cavity is formed in the upper surface of the tray and the repositioned tab is located within the cavity prior to activation of an electrical switch.

6. A method of claim 5, wherein forming the tab of the flexible printed circuit board comprises removing a portion of material from the relatively planar surface about a partial perimeter of the tab after the flexible printed circuit board is formed.

7. A method of claim 6, wherein removing a portion of material from the planar surface comprises punching the planar surface of the flexible printed circuit board.

8. A keypad assembly comprising:

a keypad support having a first surface defining a cavity; and an electrical switch coupled to the keypad support, the electrical switch comprising:

a printed circuit board having at least a portion repositionable relative to a second surface of the printed circuit board via a hinge coupling the portion to the second surface, the portion being movable relative to the second surface such that a partial opening is formed in the second surface of the printed circuit board when the repositionable portion is moved relative to the second surface, the repositionable portion being located in the cavity prior to activation of the electrical switch and the second surface being located on the first surface of the keypad support when the printed circuit board is coupled to the keypad support, the repositionable portion being attached to the second surface of the printed circuit board; and a dome switch aligned with the repositionable portion of the printed circuit board and at least partially positioned in the cavity of the keypad support.

9. The keypad assembly of claim 8, wherein the repositionable portion occupied the partial opening of the second surface prior to moving the repositionable portion relative to the second surface.

10. The keypad assembly of claim 8, further comprising a light guide film coupled to the electrical switch, the light guide film having a substantially planar shape or profile and in direct optical communication with a light source of a mobile device.

11. The keypad assembly of claim 10, further comprising an actuator assembly operatively coupled to the electrical switch via the light guide film, wherein the actuator assembly interacts with the electrical switch to generate an electrical signal when a user depresses a key associated with the electrical switch.

12. The keypad assembly of claim 11, wherein the actuator assembly comprises a keyweb having a plunger that directly engages a third surface of the light guide film.

13. The keypad assembly of claim 10 further including a keyweb having a plunger, wherein the plunger deflects the light guide film toward the dome switch to activate the electrical switch when a keycap associated with the electrical switch is depressed.

14. A keypad assembly comprising:

a keypad support having a first surface defining a cavity, the first surface comprises an upper surface of the keypad support; and an electrical switch coupled to the keypad support, the electrical switch comprising:

a printed circuit board having at least a portion repositionable relative to a second surface of the printed circuit board via a hinge coupling the portion to the second surface, the second surface being a substantially planar surface of the printed circuit board, the repositionable portion being located in the cavity prior to activation of the electrical switch and the second surface being located on the first surface of the keypad support when the printed circuit board is coupled to the keypad support, the repositionable portion being attached to the second surface of the printed circuit board; and a dome switch aligned with the repositionable portion of the printed circuit board and at least partially positioned in the cavity of the keypad support.

15. A keypad assembly comprising:

a printed circuit board mountable to a tray having a cavity, the printed circuit board having a tab integrally formed with a panel of the printed circuit board, the tab being movable relative to the panel of the printed circuit board to enable the tab to be positioned in the cavity of the tray in an offset relationship relative to the panel of the printed circuit board, wherein the tab is repositioned relative to the panel of the printed circuit board prior to activation of an electrical switch and wherein the tab supports a conductive contact of the printed circuit board and at least a portion of a trace associated with the conductive contact such that the conductive contact and the at least the portion of the trace is to be positioned within the cavity of the tray when the tab is repositioned relative to the panel of the printed circuit board.

16. The keypad assembly of claim 15, further comprising the tray, wherein the cavity is formed in a first surface of the tray.

17. The keypad assembly of claim 16, wherein when the printed circuit board is coupled to the tray, the tab is positioned in the cavity of the tray and the panel of the printed circuit board is coupled to the first surface of the tray.

18. The keypad assembly of claim 16, further comprising a dome switch at least partially disposed in the cavity and substantially aligned with the tab.

19. The keypad assembly of claim 15, wherein the printed circuit board comprises a plurality of tabs.

20. The keypad assembly of claim 15, wherein an upper surface of the tab defines an upper surface of the panel prior to the tab being repositioned relative to the panel.

* * * * *